United States Patent [19]

Amoss

[11] Patent Number: 4,997,126

[45] Date of Patent: Mar. 5, 1991

[54] FOLDABLE AND SEALABLE GREETING CARD

[75] Inventor: Berthe M. Amoss, New Orleans, La.

[73] Assignee: More Than A Card, Inc., New Orleans, La.

[21] Appl. No.: 372,847

[22] Filed: Jun. 29, 1989

[51] Int. Cl.[5] ..... B65D 15/04

[52] U.S. Cl. ..... 229/92.8; 229/79; 229/92.1

[58] Field of Search ..... 229/92.8, 92.1, 79; 282/18, 38, 40, 41

[56] References Cited

U.S. PATENT DOCUMENTS

| | | | |
|---|---|---|---|
| 1,725,007 | 8/1929 | Kovnat . | |
| 1,794,223 | 2/1931 | Zabek . | |
| 1,958,755 | 5/1934 | Ihling . | |
| 2,270,455 | 1/1942 | Lichter . | |
| 2,279,164 | 4/1942 | Gettleman . | |
| 2,723,078 | 11/1955 | Tilly . | |
| 3,266,714 | 8/1966 | Heuberger . | |
| 3,399,825 | 9/1968 | Kirchof . | |
| 3,702,171 | 11/1972 | Levine | 229/79 |
| 4,583,763 | 4/1986 | Shacklett, Jr. | 229/92.8 |

*Primary Examiner*—Stephen P. Garbe

*Attorney, Agent, or Firm*—Evenson, Wands, Edwards, Lenahan & McKeown

[57] ABSTRACT

A foldable greeting card is disclosed which is constructed with a plurality of panels connected by fold lines. Illustrations and corresponding descriptions are provided on faces of the series of panels and coordinated such that an illustration and corresponding description are always positioned adjacent one another as the series of panels is folded and unfolded at the fold lines. A removable sealing sticker is adhered in a storage position on a flat surface of one of the panels. The sealable sticker is removable from the storage space and usable to be folded over adjacent edges of the panels to hold them together in a sealed ready to be mailed condition. The surface of the panels and the adhesive surface of the sealing sticker permit removal of the sticker from its storage position, securing of the sticker to hold the package for mailing, and subsequent removal of the sticker from the greeting card package by a recipient, all without tearing or otherwise defacing the surface of the greeting card panels.

12 Claims, 2 Drawing Sheets

FOLDABLE AND SEALABLE GREETING CARD

BACKGROUND AND SUMMARY OF THE INVENTION

The present invention relates to folding and sealable greeting cards that can be mailed. The preferred embodiments of the invention relate to such foldable greeting cards made from a plurality of panels having illustrations and/or corresponding descriptions for conveying a story or other message as the card is unfolded.

Prior art greeting cards of the type generally contemplated by the present invention have been marketed under the trademark and trade name MORE THAN A CARD, by the New Orleans, La. company, More Than A Card, Inc. Those greeting cards have included panels which include pictorial representations of scenes from a nursery rhyme fairy tale or other story, collection of art or pictorial scenes with any accompanying words depicted on other foldable panels, with the panels configured so that the card can be unfolded to sequentially expose different pictorial representations and descriptive wording or accompanying art on respective adjacent side-by-side panels. These prior art cards include one panel, which is on the outside in the folded up condition, which has spaces for the sender's address, the recipient's address, and postage, so that the same can be sent as a simple compact folded greeting card.

With the prior MORE THAN A CARD greeting card, it was contemplated that some type of tape or other sealing device would seal the folded up card together at one edge to accommodate mailing by the postal services. However, these prior MORE THAN A CARD greetings cards required a sealing device separate and apart from the greeting card itself for accommodating the sealing of the folded card, this necessitating that the purchaser obtain also the card sealing device and have them readily available whenever one of the greeting cards was to be sealed and sent by mail.

Prior U.S. patents also disclose foldable greeting cards and other mailing devices which are designed to be folded up and sealed with a message enclosed in the sealed package. Examples of such patents include U.S. Pat. Nos. 1,725,007 to Kovnet; 1,794,223 to Zabek; 1,958,755 to Ihling; 2,270,455 to Lichter; 2,279,164 to Gettleman; 2,723,078 to Tilly; 3,266,714 to Heuberger; and 3,399,825. The devices disclosed in these patents include various means for accommodating sealing of the folded together package for mailing purposes, including adhesively coated portions of the foldable card or envelope itself, which adhesively coated portions are designed to be folded over and sealed against the card. Such construction require a waste of card material and special manufacture techniques for the adhesive sealing tabs, increasing the cost to manufacture the cards. Other arrangements have suggested some type of sealing stamp that could be placed over the edges of the folded card for sealing and mailing. However, these last mentioned arrangements provided for sealing stamps which could only be removed by the recipient of the sealed mailing piece with tearing or other damage to the surfaces of the card contacted by the seal, thus destroying the asthetic value of the mailing piece at a minimum, and possibly even destroying the message intended to be conveyed by the mailing piece.

An object of the present invention is to provide an improved foldable, mailable greeting card which does not exhibit the above-mentioned drawbacks of the prior art arrangements. According to the invention, this object is achieved by providing an arrangement including a foldable greeting card with a plurality of panels foldable together into a compact package and a permanent-removable adhesive sealing piece which is adhesively adhered to the greeting at a storage position spaced from the location where it is ultimately placed for sealing the folded card for mailing purposes. The adhesive sticker has a double backing called "permanent-removable" whereby the underlying layer is a permanent film which is left on the card at the storage space when the removable surface and sticker are peeled off and placed at the sealing edge for sending. The sealing piece does not harm the greeting card surface in any way by tearing or delaminating the same.

Thus, with the arrangement of the present invention, the greeting card can be marketed without any envelope in a non-sealed condition so that customers can view all of the panels of the card before purchase and can also write messages on the inside panels of the card, and then can subsequently seal the card in such a manner that the recipient can unseal the card without destroying the purpose of the card. Thus, the advantages are obtained that the sealing piece is packaged together with the card and can be applied in a very simple manner by the sender of the card and can be removed by the recipient of the card in a simple manner without degrading the quality of the card surface. These features of the sealing piece are particularly advantageous in the case of preferred embodiments of the greeting card where the design on outer panels of the greeting card when in a sealed ready to mail position extend up to the border edges which are covered by the sealing piece. For example, in the above-mentioned MORE THAN A CARD type greeting cards with panels having pictorial representations of scenes from a fairy tale or nursery rhyme, the outer panel which is first viewed by the customer when purchasing the card and by the recipient when receiving the card can be designed so as to use full surface format of that outer panel because the detachable non-destructive adhesive sealing piece can be stored in the card for commercial display purposes without obstructing the cover panel, and can then be applied and removed subsequently by the recipient, without defacing the cover panel.

According to certain preferred embodiments of the present invention the foldable greeting card is configured as a story telling mailing piece which comprises a series of panels connected by fold lines which forms a collapsible package having front and back sides by folding the series of panels along the fold lines. Illustrations and corresponding descriptions are provided on faces of the series of panels and coordinated such that an illustration and corresponding description are always positioned adjacent one another as the series of panels is folded and unfolded at the fold lines. The removable sealing device is an adhesive sticker which is adhesively connectible to a face of the series of panels for sealing and unsealing the front and back sides of the package together without damage to the mailing piece.

Particularly advantageous features of preferred embodiments of the present invention include an inside face of an inside end panel being provided with a space for a written message. Additionally, one of the front and back sides of the folded package is provided with a space for placing an address, postage stamp and return address. Further, one of the front and back sides of the envelope is provided with a title page describing the story to be told. Moreover, the mailing piece can be constructed so that the story told is a game such as, for example, a child's game. Also, the mailing piece may be constructed as a collection of stories or a collection of pictures or art.

Other objects, advantages and novel features of the present invention will become apparent from the following detailed description of the invention when considered in conjunction with the accompanying drawings.

BRIEF DESCRIPTION OF THE DRAWINGS

FIGS. 2*a*–2*f* illustrate the folding sequence of the greeting card illustrated in FIGS. 1*a*–1*b* to form a mailable package.

DETAILED DESCRIPTION OF THE DRAWINGS

Figure 1A:
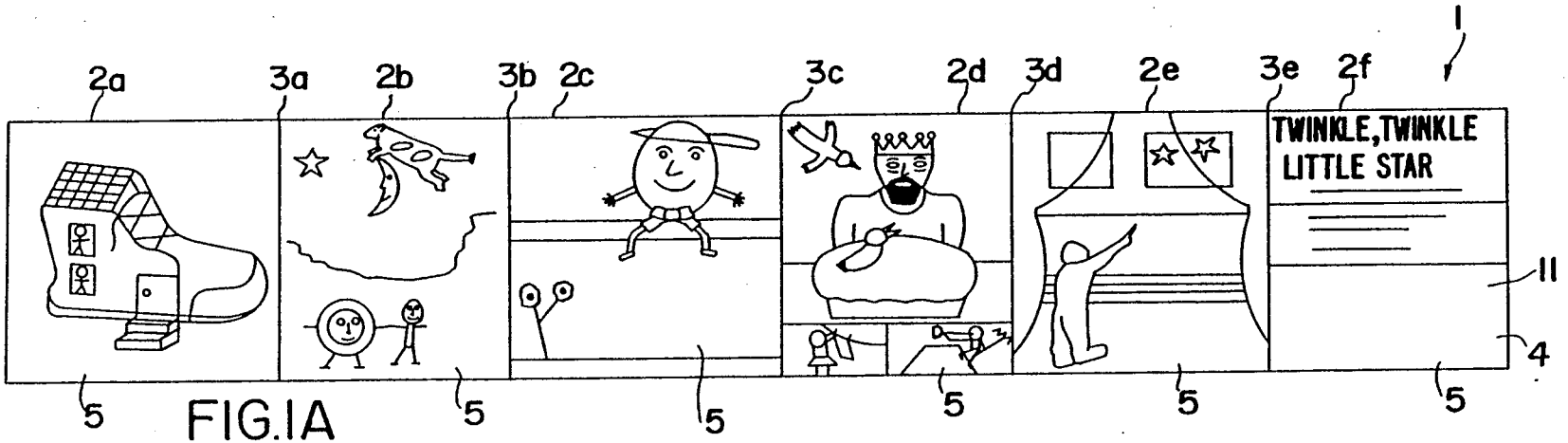
FIG. 1*a* illustrates the arrangement of the inside faces of an unfolded greeting card constructed in accordance with a preferred embodiment of the present invention.
Figure 1B:
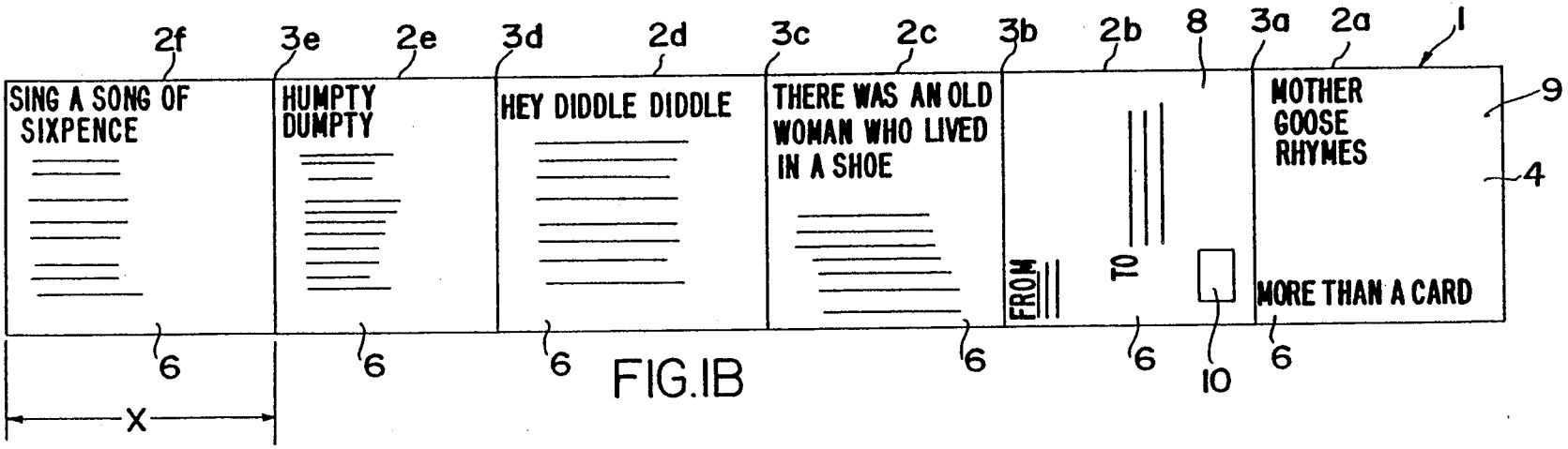
FIG. 1*b* illustrates the arrangement of the outside faces of the unfolded mailing piece illustrated in FIG. 1*b;*

FIGS. 1*a* and 1*b* illustrate inside and outside faces, respectively, of an unfolded greeting card configured as a story telling piece. The greeting card 1 comprises a series of panels 2*a*–2*f* connected by fold lines 3*a*–3*e* to form an elongated sheet 4.

Each panel 2*a*–2*f* is provided with an inside face 5 and an outside face 6, including illustrations and corresponding descriptions coordinated such that an illustration and corresponding description are always positioned adjacent one another as the series of panels 2*a*–2*f* is folded and unfolded at the fold lines 3*a*–3*e*. While a series of six panels is illustrated in FIGS. 1*a* and 1*b*, it is understood that any number of panels may be employed to construct the story telling mailing piece according to the present invention.

Figure 2A:
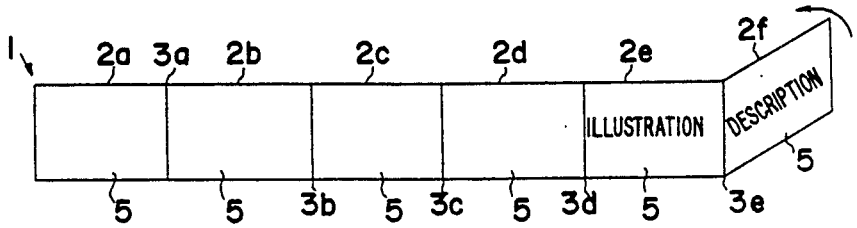
Figure 2B:
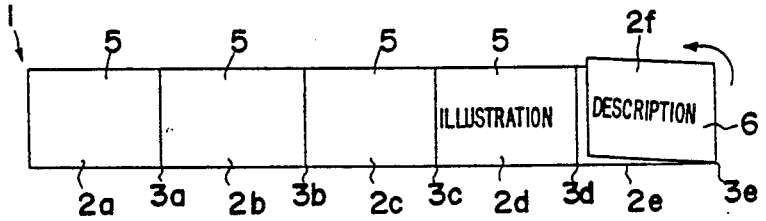
Figure 2C:
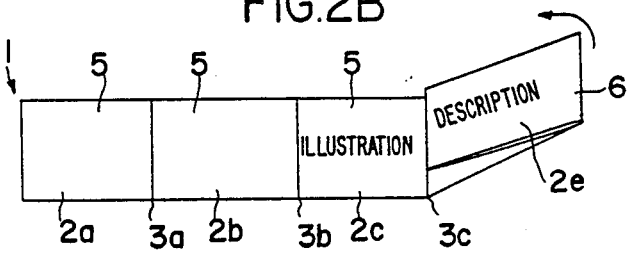
Figure 2D:
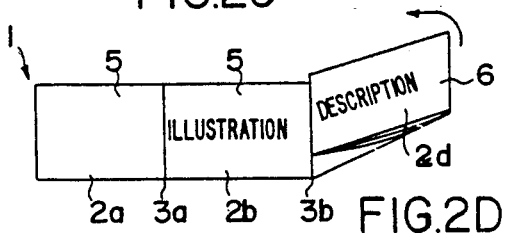
Figure 2E:
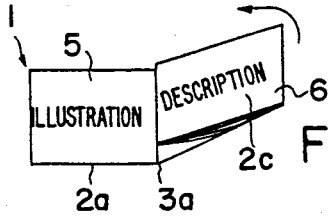

Referring to FIGS. 2*a*–2*e*, the folding operation for forming a mailable package 7 (FIG. 3) from the greeting card 1 from the series of unfolded panels 2*a*–2*f* is illustrated. Typically, the inside end panel 2*f* is folded on top of the adjacent panel 2*e* along fold line 3*e* so that the outside face 6 of the inside end panel 2*f* is positioned adjacent to the inside face 5 of the adjacent panel 2*d* as best shown in FIG. 2*b*. This folding operation along the fold lines 3 is continued, as illustrated by the arrow in FIG. 2*b*, so that the outside face 6 of panel 2*e* is positioned adjacent the inside face 5 of the adjacent panel 2*c* as shown in FIG. 2*c*. As the folding sequence continues, the outside face 6 of panel 2*d* is folded along fold line 3*c* to be positioned adjacent the inside face 5 of panel 2*b* as seen in FIG. 2*d*. Thereafter, the outside face 6 of panel 2*c* is positioned adjacent the inside face 5 of the outside panel 2*a* as shown in FIG. 2*e*. Preferably, the lateral dimension X of each panel 2*a*–2*f* increases slightly from the inside end panel 2*f* to the outside end panel 2*a* to permit the panels 2*a*–2*f* to fold on top of one another without binding or bending.

Figure 3:
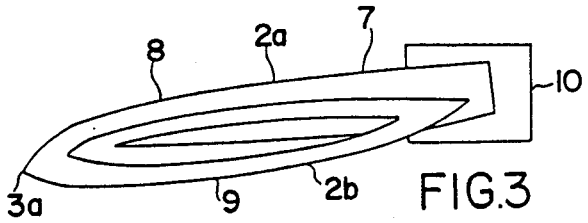
FIG. 3 is a side view illustrating the arrangement of the removable sticker sealing piece for sealing the package formed by folding the series of panels along their fold lines.

To form the package 7 having front and back sides 8, 9 of the greeting card 1, panel 2*b* is folded along fold line 3*a* and on top of outside end panel 2*a* as illustrated in FIG. 3. A removable adhesive sticker 10 is fixed to a face of the series of panels 2*a*–2*f* to be employed to accommodate sealing and unsealing of the front and back sides 8, 9 of the envelope without damage to the surface of the card panel surfaces adhered to store.

Preferably the seal 10 is fixed in its storage or display position to one of the front and back sides 8,9 of the package 7 as illustrated in FIG. 1*b*, a title page describing the story being told being provided on one of the front and back sides 8, 9 of the package and a space for placing an address, postage stamp and a return address being provided on the other of the front end back sides 8,9 of the package 7. The removable seal 10 is provided with an adhesive which is matched to the card surface at its storage location so as to be easily manually removable, while preventing tearing or ripping of the card surface device 1. The seal 10 is sufficiently adhesive to hold the edges of the folded package together for mailing purposes while still permitting unsealing and removal without damage to the surface of the card contacted by the seal 10 in the sealed mailing condition.

In operation, the story telling folding card 1 is received in the folded state illustrated in FIG. 3. As the series of panels 2*a*–2*f* are sequentially unfolded along fold lines 3*a*–3*e*, in reverse order to the folding sequence shown in FIGS. 2*a*–2*e*, an illustration and corresponding description are always positioned adjacent one another. Therefore, as the story telling mailing piece 1 is unfolded, a story, collection of stories and/or a game, such as a child's game is told. Once the inside end panel 2*f* is exposed, the space 11 is revealed to provide a short message and/or the name of the individual sending the mailing piece 1.

Additionally, a space 11 is preferably provided on the inside face 5 of the inside end panel 2*f* for a written message and signature of the sender.

Preferred embodiments of the greeting cards are made of 190 GSM art card material.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A foldable greeting card comprising:

a series of panels connected by fold lines to accommodate folding the series of panels into a foldable mailable package with the panels stacked one on top of the other; and a removable adhesive sealing sticker adhesively connected to a storage position on one of the panels and being manually movable to a folded over sealing position for sealing and unsealing front and back sides of the foldable mailable package together, wherein the surface of the panels at least at the location of the storage position and the location where the sealing sticker is to be adhered in the folded over condition to the front and back sides of the foldable mailable package and the surface of the sealing sticker facilitate removal of the sealing sticker from either the storage position or the sealing position without damaging the surface of the card contacted thereby.

2. A greeting card according to claim 1, wherein the series of panels includes a cover panel and a mailing address panel which face oppositely of one another when said greeting card is in a folded together package position for accommodating sales display and mailing thereof, and wherein said storage position of the adhesive sealing sticker means is disposed on a panel other than the cover panel.

3. A greeting card according to claim 2, wherein the adhesive sealing sticker means exhibits a visible color that is different from the color of the panel containing the same in the storage position to facilitate ready identification of same.

4. A greeting card according to claim 2, wherein said adhesive sealing sticker means includes an identifying printed label thereon.

5. A greeting card according to claim 2, wherein the storage position for the adhesive sealing sticker means is on the panel with the mailing address.

6. A greeting card according to claim 5, wherein the storage position for the adhesive sealing means is located on the mailing address panel at a position spaced from the intended location for a postage stamp.

7. A greeting card according to claim 1, wherein said adhesive sealing sticker means includes an identifying printed label thereon.

8. A greeting card according to claim 1, wherein the series of panels includes an outside end panel and an inside end panel, each panel of the series of panels having an inside face and an outside face.

9. A greeting card according to claim 8, wherein the series of panels are folded one on top of another from the inside end panel to the outside end panel such that the outside face of a folded panel is positioned adjacent an inside face of an adjacent unfolded panel as the series of panels is folded along the fold lines.

10. A greeting card according to claim 9, wherein the inside face of the inside end panel has a space for a written message.

11. A greeting card according to claim 8, wherein panels of the series of panels have increasing lateral dimensions as the panels progress from the inside end panel to the outside end panel.

12. A greeting card according to claim 1, wherein the series of panels include pictorial depiction of scenes from a story, one respective panel depicting one scene and a corresponding written description associated with said one scene on another panel being simultaneously visible during unfolding of the greeting card.

* * * * *